US006555305B1

(12) United States Patent
Vargas et al.

(10) Patent No.: US 6,555,305 B1
(45) **Date of Patent: *Apr. 29, 2003**

(54) PHOTOGRAPHIC ELEMENT WITH SPECTRALLY SENSITIZED TABULAR GRAIN EMULSION AND RETAINED DYE STAIN REDUCING COMPOUND

(75) Inventors: J. Ramon Vargas, Webster, NY (US); Margaret D. Steele, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/027,299

(22) Filed: Dec. 21, 2001

(51) Int. Cl.[7] ..... G03C 1/08; G03C 7/26; G03C 7/32

(52) U.S. Cl. ..... 430/543; 430/567; 430/570; 430/551

(58) Field of Search ..... 430/570, 567, 430/551, 543

(56) References Cited

U.S. PATENT DOCUMENTS 5,188,926 A 2/1993 Schofield et al.
5,192,646 A 3/1993 Merkel et al.
5,352,572 A 10/1994 Seto et al.
5,747,236 A 5/1998 Farid et al.

*Primary Examiner*—Geraldine Letscher
(74) *Attorney, Agent, or Firm*—Andrew J. Anderson

(57) ABSTRACT

A photographic element is disclosed comprising a silver halide emulsion layer including a spectrally sensitized tabular grain emulsion and having associated therewith a compound of the following Formula I:

I wherein n=0–6 and each R is independently hydrogen, an aromatic, cyclic, linear or branched chain hydrocarbon group, NR'R", or OR'; where R' is an aromatic, cyclic, linear or branched chain hydrocarbon group and R" is hydrogen or an aromatic, cyclic, linear or branched chain hydrocarbon group. The use of dipiperidinediamide, dipiperidinedicarbamate or dipiperidinediurea compounds of Formula I in photographic elements comprising spectrally sensitized tabular grain silver halide emulsions exhibit reduced sensitizing dye stain after photographic processing. In addition to dye-stain reducing properties, compounds of Formula I have organic solvent properties, and accordingly may be advantageously used partly or totally in place of conventional high boiling permanent and/or auxiliary organic coupler solvents to disperse dye-forming couplers.

18 Claims, No Drawings

PHOTOGRAPHIC ELEMENT WITH SPECTRALLY SENSITIZED TABULAR GRAIN EMULSION AND RETAINED DYE STAIN REDUCING COMPOUND

FIELD OF INVENTION

This invention relates to silver halide photographic materials. More particularly, it relates to color photographic materials which contain spectrally sensitized tabular grain silver halide emulsions and dye-forming couplers in combination with non-imaging compounds which give rise to photographic images which have reduced levels of retained sensitizing dye after photographic processing.

BACKGROUND OF THE INVENTION

The conventional image-forming process of silver halide photography includes imagewise exposure of a photographic silver halide recording material to actinic radiation (such as visible light), and the eventual manifestation of a useable image by wet photochemical processing of that exposed material. A fundamental step of photochemical processing is the treatment of the material with one or more developing agents to reduce silver halide to silver metal. With black-and-white photographic materials, the metallic silver usually comprises the image. With color photographic materials, the useful image consists of one or more organic dye images produced from an oxidized color developing agent formed wherever silver halide is reduced to metallic silver. To obtain useful color images, it is usually necessary to remove all of the silver from the photographic element after color development. This is sometimes known as "desilvering". Removal of silver is generally accomplished by oxidizing the metallic silver, and then dissolving it and undeveloped silver halide with a "solvent" or fixing agent in what is known as a fixing step. Oxidation is achieved using an oxidizing agent, commonly known as a bleaching agent. For some processing methods, these two steps can be performed in the same processing step in what is known as bleach-fixing. Common bleaching agents include ferric salts and ferric complexes of various polycarboxylic or polyaminopolycarboxylic chelating ligands. Common fixing agents include thiosulfate salts (both ammonium and sodium thiosulfate salts) and thiocyanates.

Photographic silver halide materials often contain various spectral sensitizing dyes that extend the inherent photosensitivity of the photosensitive silver halide emulsions to electromagnetic radiation. One important class of such spectral sensitizing dyes includes carbocyanine sensitizing dyes that are commonly included in silver halide emulsion layers in photographic silver halide films. For example they are often present in color paper and color reversal photographic silver halide elements (photographic elements normally used to provide color positive images), as well as color negative photographic elements. Many photographic silver halide elements contain residual spectral sensitizing dyes after photoprocessing. In some cases, the level of retained spectral sensitizing dyes is inconsequential and thus, unobservable. In other instances, however, the high level of retained spectral sensitizing dye results in undesirably high dye stain (or unwanted color) in the elements. High levels of sensitizing dye can result in processed papers and reversal films which are visibly objectionable, and in negative films with inferior printing characteristics.

Tabular silver halide grains are generally regarded as silver halide grains having an aspect ratio of at least 2, where aspect ratio is defined as the equivalent circular diameter (ECD) of the major face of the grain divided by the grain thickness. A tabular grain emulsion is generally considered to be an emulsion for which greater than 50% of the total grain projected area of the emulsion is accounted for by tabular grains. Kofron, et al., U.S. Pat. No. 4,439,520 ushered in the current era of high performance silver halide photography. Kofron, et al., disclosed and demonstrated striking photographic advantages for chemically and spectrally sensitized tabular grain silver halide emulsions in which grains having a diameter of at least 0.6 $\mu$m and a thickness of less than 0.3 $\mu$m exhibit an average aspect ratio of greater than 8 and account for greater than 50 percent of total silver halide grain projected area. Kofron, et al., recognized that the chemically and spectrally sensitized emulsions disclosed in one or more of their various forms would be useful in color photography and in black-and-white photography (including indirect radiography). Spectral sensitizations in all portions of the visible spectrum and at longer wavelengths were addressed as well as orthochromatic and panchromatic spectral sensitizations for black-and-white imaging applications. Kofron, et al., employed combinations of one or more spectral sensitizing dyes along with middle chalcogen (e.g., sulfur) and/or noble metal (e.g., gold) chemical sensitizations, although still other conventional sensitizations, such as reduction sensitization were also disclosed.

When silver halide elements contain tabular grain silver halide emulsions, however, retained sensitizing dye stain problems may be aggravated due to the increased surface areas of the tabular grains requiring higher concentrations of spectral sensitizing dyes for optimal sensitization. Retained sensitizing dye stain is further aggravated for color elements which include dye-forming couplers due to interactions between the sensitizing dyes and couplers, or when the elements are designed for relatively short wet processing times such that less sensitizing dye is removed during shortened processing steps. Retained sensitizing dye can particularly be detrimental for color reversal elements, where the formed color image is intended for direct or projected viewing.

U.S. Pat. Nos. 5,188,926 and 5,192,646 teach the use of carbonamide and sulfoxide coupler solvents, respectively, to reduce sensitizing dye stain for certain applications. U.S. Pat. No. 5,352,572 disclose the use of bis urea, bis amide, and bis carbamate solvents in photographic elements, but no teaching is made to advantages for sensitizing dye stain, nor are any dipiperidine derivatives disclosed.

While various approaches have been proposed to minimize retained sensitizing dyes in photographic elements, it would be desirable to provide further improvements, particularly with respect to photographic elements employing spectrally sensitized tabular grain silver halide emulsions, more particularly for color photographic elements employing spectrally sensitized tabular grain silver halide emulsions, and especially for color reversal photographic elements employing spectrally sensitized tabular grain silver halide emulsions.

SUMMARY OF THE INVENTION

An objective of this invention is to provide photographic elements comprising spectrally sensitized tabular grain silver halide emulsions which exhibit reduced sensitizing dye stain after photographic processing. The present invention solves the problem by employing a substituted dipiperidine additive in the elements of the invention. In accordance with the invention, a photographic element is disclosed comprising a silver halide emulsion layer including a spectrally sensitized tabular grain emulsion and having associated therewith a compound of the following Formula I:

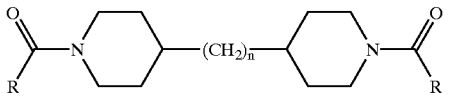

I wherein n=0–6 and each R is independently hydrogen, an aromatic, cyclic, linear or branched chain hydrocarbon group, NR'R", or OR', where R' is an aromatic, cyclic, linear or branched chain hydrocarbon group and R" is hydrogen or an aromatic, cyclic, linear or branched chain hydrocarbon group.

We have found that the objective of the invention can be achieved with the use of dipiperidinediamide, dipiperidinedicarbamate or dipiperidinediurea compounds of Formula I as dye stain reducing addenda. In accordance with preferred embodiments of the invention, such compounds may be used in combination with dye-forming couplers. In addition to dye-stain reducing properties, compounds of Formula I have organic solvent properties, and accordingly may be advantageously used partly or totally in place of conventional high boiling permanent and/or auxiliary organic coupler solvents to disperse the dye-forming couplers. Photographic elements of the present invention upon exposure and photographic processing exhibit good activity and yield images that have unexpected and substantial improvements with respect to reduced levels of retained sensitizing dyes.

DETAILED DESCRIPTION OF THE INVENTION

Tabular grain silver halide emulsions employed in the elements of this invention are those emulsions which include silver halide grains of tabular shape having an aspect ratio of at least 2:1, preferably at least 5:1, and optimally at least 7:1, which account for greater than 50%, preferably greater than 70% and more preferably greater than 90%, of the total grain projected area of the emulsion. Aspect ratio as used herein is understood to mean the ratio of the equivalent circular diameter of a grain to its thickness. The equivalent circular diameter of a grain is the diameter of a circle having an equal to the projected area of the grain. Tabular grain silver halide photographic emulsions useful in this invention are generally prepared by precipitating silver halide crystals in a colloidal matrix by methods conventional in the art. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation. The colloid is typically a hydrophilic film-forming agent such as gelatin, alginic acid, or derivatives thereof. The silver halide emulsions utilized in this invention may be comprised of any halide distribution. Thus, they may be comprised of silver bromoiodide, silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions.

In a preferred embodiment of the invention, the photographic element is a color reversal photographic element, and the silver halide emulsion is a predominantly high bromide emulsion. By high bromide, it is meant that the grains of the emulsion are greater than about 50 mole percent silver bromide. Preferably, they are greater than about 80 mole percent silver bromide, and optimally greater than about 85 mole percent silver bromide. The iodide content of the high bromide grains can range up to saturation levels, e.g., up to approximately 40 mole percent, based on total silver, in a silver iodobromide composition. Preferably the iodide content is less than 20 mole percent and, most commonly less than 12 mole percent, based on total silver. Generally iodide concentrations as low as about 0.1 mole percent, based on total silver, produce demonstrable photographic performance advantages, with minimum iodide concentrations of at least 0.5 mole percent, based on total silver, being preferred for photographic performance advantages, such as an improved speed-granularity relationship, to be realized. Silver chloride can be present in the high bromide grains in concentrations of up to 50 mole percent. Preferred silver halide emulsions are iodobromide emulsions with an iodide content of 1 to 12%.

High aspect ratio tabular grain emulsions are specifically contemplated and preferred for use in the elements of the invention, such as those disclosed by Wilgus, et al., U.S. Pat. No. 4,434,226, Daubendiek, et al., U.S. Pat. No. 4,414,310, Wey, U.S. Pat. No. 4,399,215, Solberg, et al., U.S. Pat. No. 4,433,048, Mignot, U.S. Pat. No. 4,386,156, Evans, et al., U.S. Pat. No. 4,504,570, Maskasky, U.S. Pat. No. 4,400,463, Wey, et al., U.S. Pat. No. 4,414,306, Maskasky, U.S. Pat. Nos. 4,435,501 and 4,643,966 and Daubendiek, et al., U.S. Pat. Nos. 4,672 and 4,693,964, all of which are incorporated herein by reference. Also, specifically contemplated are those silver iodobromide grains with a higher molar proportion of iodide in the core of the grain than in the periphery of the grain, such as those described in British Reference No. 1,027,146; U.S. Pat. Nos. 4,379,837; 4,444,877; 4,665,012; 4,686,178; 4,565,778; 4,728,602; 4,668,614 and 4,636,461 and in the European Reference No. 264,954, all of which are incorporated herein by reference. The silver halide emulsions can be either monodisperse or polydisperse as precipitated. The grain size distribution of the emulsions can be controlled by silver halide grain separation techniques or be blending silver halide emulsions of differing grain sizes. The tabular grain emulsions may include sensitization comprising epitaxially deposited silver halide protrusions at the comers and edges of the host tabular emulsion (e.g. Daubendiek, et al., U.S. Pat. Nos. 5,576,168 and 5,573,902; Olm, et al., U.S. Pat. Nos. 5,503,970 and 5,576,171, Deaton, et al., U.S. Pat. No. 5,582,965).

The grains can be contained in any conventional dispersing medium capable of being used in photographic emulsions. Specifically, it is contemplated that the dispersing medium be an aqueous gelatino-peptizer dispersing medium, of which gelatin—e.g., alkali treated gelatin (cattle bone and hide gelatin)—or acid treated gelatin (pigskin gelatin) and gelatin derivatives—e.g., acetylated gelatin, phthalated gelatin—are specifically contemplated. When used, gelatin is preferably at levels of 0.01 to 100 grams per total silver mole. Also contemplated are dispersing mediums comprised of synthetic colloids.

The silver halide grain crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The general methods for precipitation and spectral and chemical sensitization utilized in preparing the emulsions employed in the invention can be those general methods known in the art.

Spectral sensitization is typically effected with dyes which are designed for the wavelength range of interest within the visible or infrared spectrum. It is known to add such dyes both before and after heat treatment. The silver halide may be sensitized by sensitizing dyes by any method known in the art. Spectral sensitizing dyes typically present in color photographic materials are described in numerous publications including for example, U.S. Pat. No. 5,747,236 (Farid, et al.), incorporated by reference herein. Examples of dyes include dyes from a variety of classes, including the polymethine dye class, which includes the cyanines, merocyanines, complex cyanines and merocyanines (i.e., tri-, tetra-, and poly-nuclear cyanines and merocyanines), oxonols, hemioxonols, stryryls, merostyryls, and streptocyanines. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating of the emulsion layers. Various coating techniques include dip coating, air knife coating, curtain coating and extrusion coating.

Compounds of Formula I which are employed as retained dye-stain reducing compounds in photographic elements in accordance with the present invention may be prepared according to synthetic methods known in the art. R, R' and R" may be linear, cyclic or branched chained hydrocarbon groups, which may be the same or different, preferably ranging from 1 to 22 carbon atoms, more preferably from 1 to 14 carbon atoms and most preferably from 1 to 10 carbon atoms. Where R is NR'R", R' and R" may optionally combine together to form a ring with the associated nitrogen atom (such as piperidine or morpholine). Representative examples include: methyl, ethyl, propyl, iso-propyl, butyl, iso-butyl, pentyl, hexyl, ethylhexyl, octyl, nonyl, iso-nonyl, decyl, iso-decyl, undecyl, dodecyl, tridecyl, tetradecyl, myristyl, pentadecyl, cetyl, stearyl, arachidyl, behenyl, undecylenyl, palmitoleyl, oleyl, linoleyl, linolenyl, arachidonyl, erucyl, benzyl, cyclohexyl, phenoxyethyl and phenyl. This list is non exhaustive and may also include numerous other linear, branched chain, cyclic, or aromatic hydrocarbon groups.

Throughout this application a reference to any type of chemical "group" includes both the unsubstituted and substituted forms of the group described. Generally, unless otherwise specifically stated, substituent groups usable on molecules herein include any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the mentioned groups can include known substituents, such as: halogen, for example, chloro, fluoro, bromo, iodo; alkoxy, particularly those with 1 to 6 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); and others known in the art. Alkyl substituents may specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

Specific examples of compounds of Formula I include, but are not limited to, the following:

| | Formula I | | | |
|---|---|---|---|---|
| Compound | n | R | R' | R" |
| Ia | 3 | NR'R" | Et | Et |
| Ib | 3 | NR'R" | i-Pr | i-Pr |
| Ic | 3 | NR'R" | Me | Me |
| Id | 3 | NR'R" | i-Bu | i-Bu |
| Ie | 3 | NR'R" | Bu | Me |
| If | 3 | NR'R" | —$(CH_2)_5$— | |
| Ig | 3 | NR'R" | $C_5H_{11}$ | $C_5H_{11}$ |
| Ih | 3 | NR'R" | —$CH_2CH(Me)OCH(Me)CH_2$— | |
| Ii | 3 | cyclo-$C_6H_{11}$ | — | — |
| Ij | 3 | $C_6H_{13}$ | — | — |
| Ik | 3 | $C_8H_{17}$ | — | — |
| Il | 2 | NR'R" | i-Pr | i-Pr |
| Im | 2 | NR'R" | i-Bu | i-Bu |
| In | 2 | NR'R" | $C_5H_{11}$ | $C_5H_{11}$ |
| Io | 2 | cyclo-$C_6H_{11}$ | — | — |
| Ip | 0 | NR'R" | i-Bu | i-Bu |
| Iq | 0 | NR'R" | $C_5H_{11}$ | $C_5H_{11}$ |
| Ir | 0 | $C_8H_{17}$ | — | — |
| Is | 0 | $C_{11}H_{23}$ | — | — |
| It | 3 | OR' | Et | — |
| Iu | 3 | OR' | Pr | — |
| Iv | 3 | OR' | Bu | — |
| Iw | 3 | NR'R" | $C_8H_{17}$ | H |
| Ix | 3 | NR'R" | Et | $CH_2C(Me)=CH_2$ |
| Iy | 3 | NR'R" | s-Bu | s-Bu |
| Iz | 3 | $C_5H_{11}$ | — | — |
| Iaa | 3 | CH(Et)Bu | — | — |
| Iab | 3 | CH=CHPh | — | — |
| Iac | 3 | $CH_2CH_2Ph$ | — | — |
| Iad | 3 | NR'R" | Me | Ph |
| Iae | 3 | $CH(Bu)C_6H_{13}$ | — | — |
| Iaf | 3 | $CHPr_2$ | — | — |
| Iag | 3 | $CH(C_6H_{13})C_8H_{17}$ | — | — |
| Iah | 3 | $C_{11}H_{23}$ | — | — |
| Iai | 3 | OR' | $CH_2CH=CH_2$ | — |
| Iaj | 3 | p-tolyl | — | — |
| Iak | 3 | p-(t-Bu)Ph | — | — |
| Ial | 3 | p-(OMe)Ph | — | — |
| Iam | 3 | p-$(NO_2)$Ph | — | — |
| Ian | 3 | p-$(OC_{12}H_{25})$Ph | — | — |

Syntheses of these compounds may use standard procedures as exemplified for the following synthesis of compound Ia: To a solution of 105.2 g of 4,4'-trimethylenedipiperidine dissolved in 800 mL of ethyl acetate was added a solution of 124.7 g of diethylcarbamyl chloride in 100 mL of ethyl acetate over 50 min. The resulting mixture was heated at reflux for one hour, then held at ambient temperature overnight. The reaction mixture was filtered and the solids were washed with ethyl acetate then heptane. The combined filtrates were washed four times with 2 N HCl, once with water, and concentrated in vacuo to provide an oil. Gas chromatography analysis determined the sample to be >96% pure. Combustion analysis for $C_{23}H_{44}N_4O_2$ (calcd, found): C(67.61, 67.44); H(10.84, 10.81); N(13.71, 13.63).

In accordance with a preferred embodiment of the present invention, the compounds of Formula I are used in photographic elements in combination with yellow, magenta, or cyan dye-forming couplers. Such couplers are known compounds and can be prepared by techniques known to those skilled in the art, and may be used singly or in combinations. Couplers that form yellow dyes upon reaction with oxidized color developing agent and which are useful in elements of the invention are described, e.g., in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds, and in particular acetanilide-based yellow dye forming coupler compounds are preferred. Also preferred are yellow couplers such as described in, for example, European Patent Application Nos. 482,552; 510,535; 524,540; 543,367; and U.S. Pat. No. 5,238,803.

Typical preferred acetanilide-based yellow couplers are represented by the following formulas:

YELLOW-1

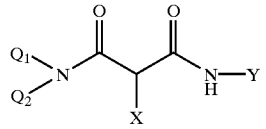

YELLOW-2

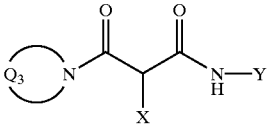

YELLOW-3

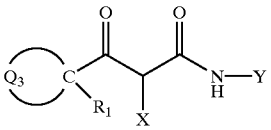

YELLOW-4

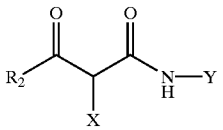

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring. Preferred couplers are of YELLOW-1 and YELLOW-4 wherein $Q_1$ and $Q_2$ each represent an alkyl group, an aryl group, or a heterocyclic group, and $R_2$ represents an aryl or alkyl group, including cycloalkyl and bridged cycloalkyl groups, and more preferably a tertiary alkyl group. Particularly preferred yellow couplers for use in elements of the invention are represented by YELLOW-4, wherein $R_2$ represents a tertiary alkyl group and Y represents an aryl group, and X represents an aryloxy or N-heterocyclic coupling-off group. The elements of the invention are particularly useful in combination with yellow couplers of the above formulas wherein X represents a nitrogen-containing heterocyclic coupling-off group.

Image dye forming couplers that form magenta dyes upon reaction with oxidized color developing agents may be included in elements of the invention, such as are described in representative patents and publications such as: U.S. Pat. No. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo[5,1-c]-1,2,4-triazole and 1H-pyrazolo[1,5-b]-1,2,4-triazole. Examples of 1H-pyrazolo[5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo[1,5-b]-1,2,4-triazoles can be found in European Patent Applications 176,804; 177,765; U.S. Pat. Nos. 4,659,652; 5,066,575; and 5,250,400.

Typical pyrazoloazole and pyrazolone couplers are represented by the following formulas:

MAGENTA-1

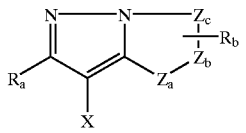

MAGENTA-2

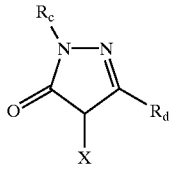

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Image dye forming couplers that form cyan dyes upon reaction with oxidized color developing agents may be included in elements of the invention, such as are described in representative patents and publications such as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Typical cyan couplers are represented by the following formulas:

CYAN-1

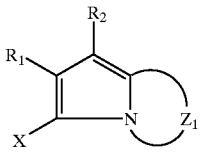

CYAN-2

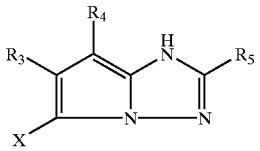

CYAN-3

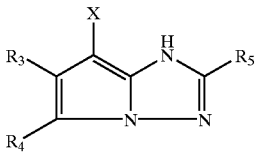

CYAN-4

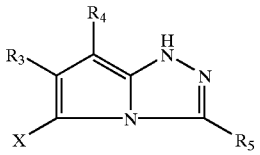

CYAN-5

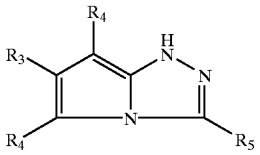

CYAN-6

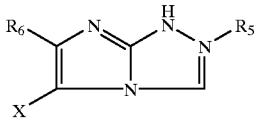

wherein $R_1$ and $R_5$ each represent a hydrogen or a substituent, $R_2$ represents a substituent; $R_3$ and $R_4$ each represent an electron attractive group having a Hammett's substituent constant $\sigma_{para}$ of 0.2 or more and the sum of the $\sigma_{para}$ values of $R_3$ and $R_4$ is 0.65 or more; $R_6$ represents an electron attractive group having a Hammett's substituent constant $\sigma_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group. A dissociative group has an acidic proton, e.g. —N—, —CH(R)—, etc., that preferably has a pKa value of from 3 to 12 in water. The values for Hammett's substituent constants can be found or measured as is described in the literature. For example, see C. Hansch and A. J. Leo, *J. Med. Chem.,* 16, 1207 (1973); *J. Med. Chem.,* 20, 304 (1977); and J. A. Dean, *Lange's Handbook of Chemistry,* 12th Ed. (1979) (McGraw-Hill).

More preferable are cyan couplers of the following formulas:

CYAN-7

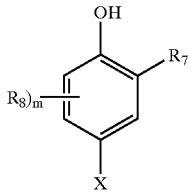

CYAN-8

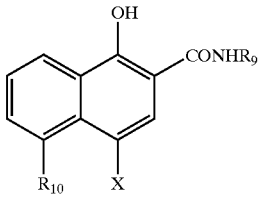

wherein $R_7$ represents a substituent (preferably a carbamoyl, ureido, or carbonamido group); $R_8$ represents a substituent (preferably individually selected from halogen, alkyl, and carbonamido groups); $R_9$ represents a ballast substituent; $R_{10}$ represents a hydrogen or a substituent (preferably a carbonamido or sulphonamido group); X represents a hydrogen or a coupling-off group; and m is from 1–3. Couplers of the structure CYAN-7 are most preferable for use in elements of the invention.

The yellow, cyan and magenta dye forming couplers that may be used in the elements of the invention can be defined as being 4-equivalent or 2-equivalent depending on the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published Application Nos. 1,466,728; 1,531,927; 1,533,039, 2,006,755A and 2,017,704A, the disclosures of which are incorporated herein by reference.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to polymeric backbone.

Representative couplers which may be used in the elements of the invention include the following yellow couplers YC1–YC21, magenta couplers MC1–MC17, and cyan couplers CC1–CC17:
YC1
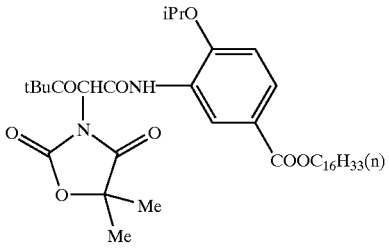
YC2
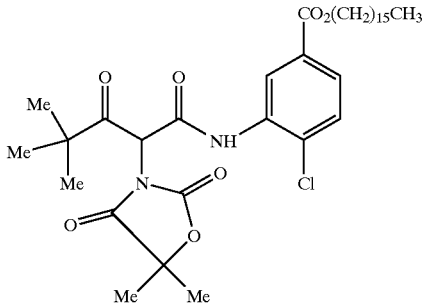
YC3
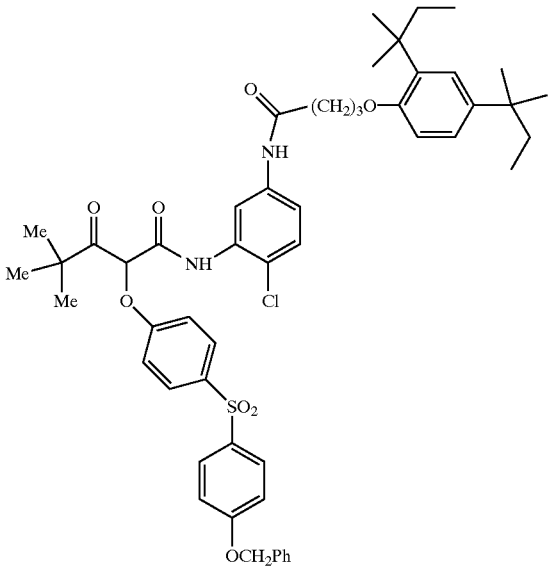
YC4
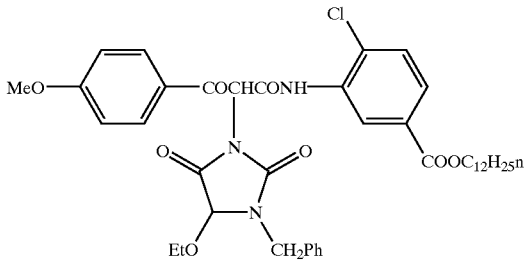
YC5
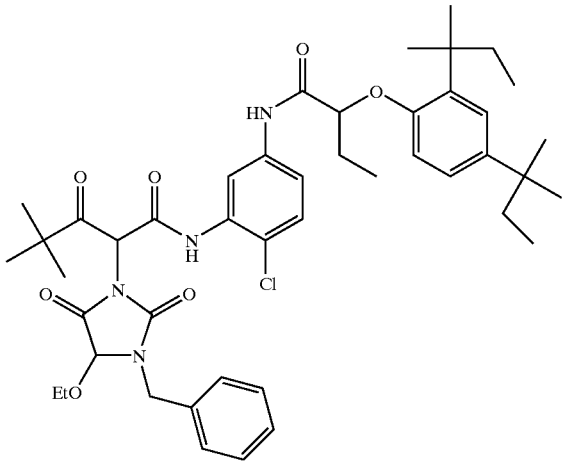
YC6
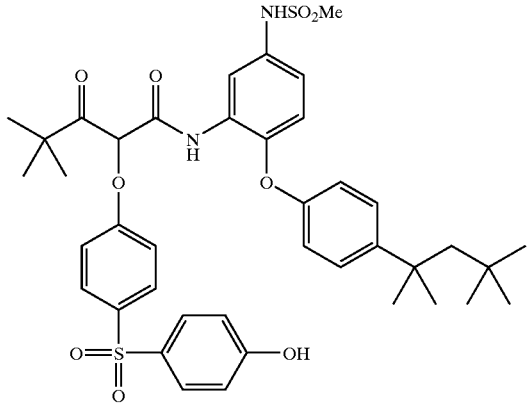

-continued
YC7
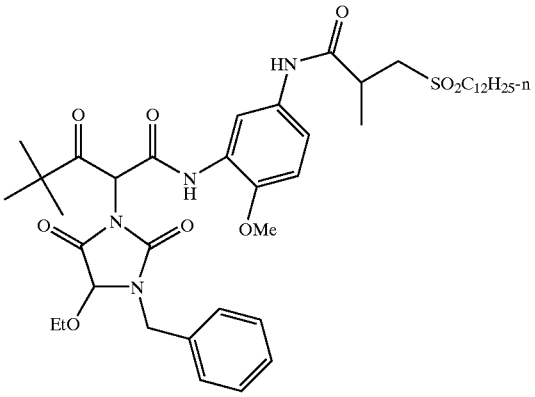
YC8
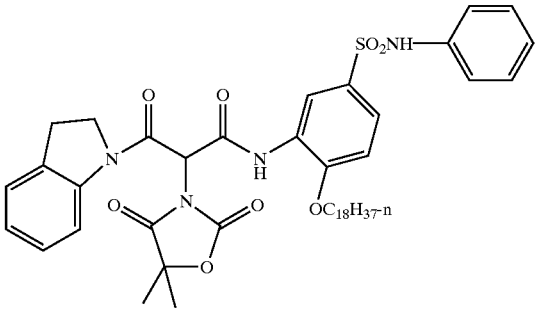
YC9
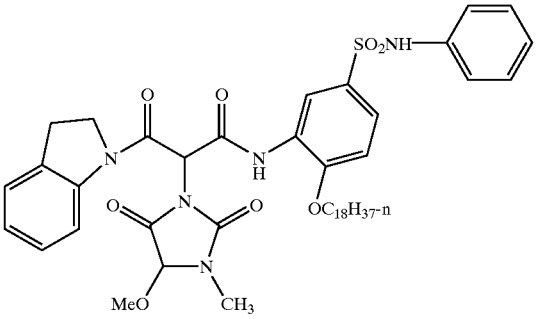
YC10
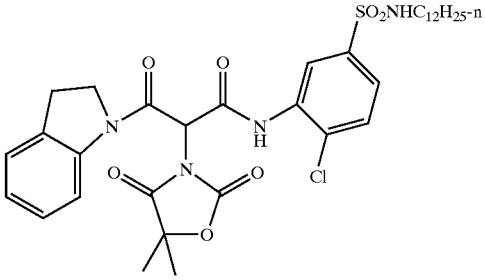
YC11
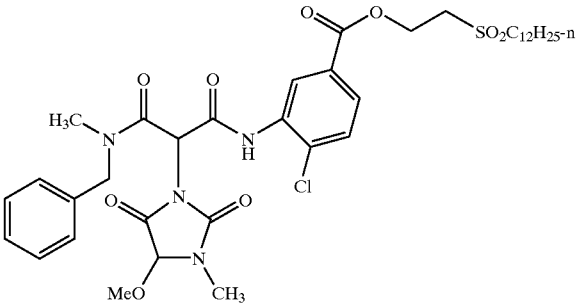
YC12
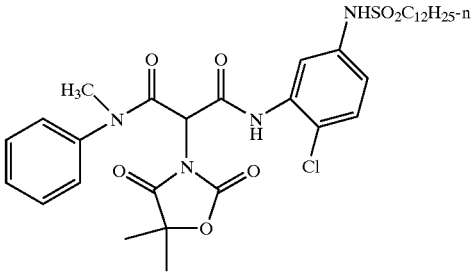
YC13
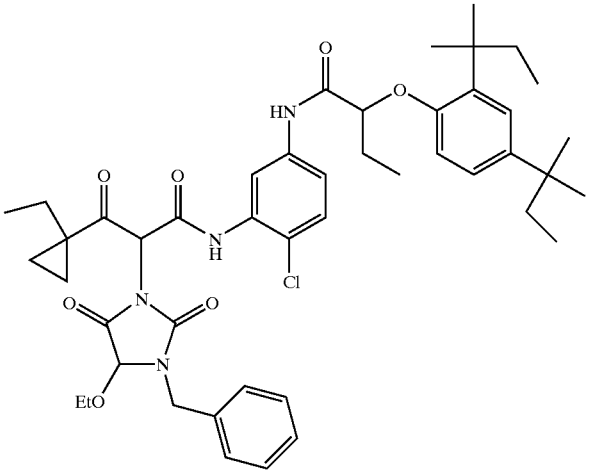
YC14
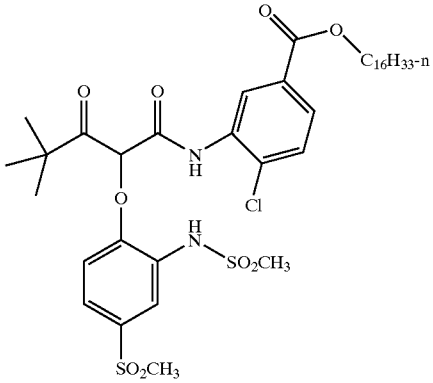

-continued
YC15
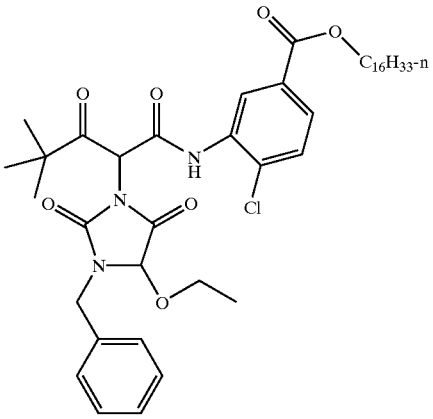
YC16
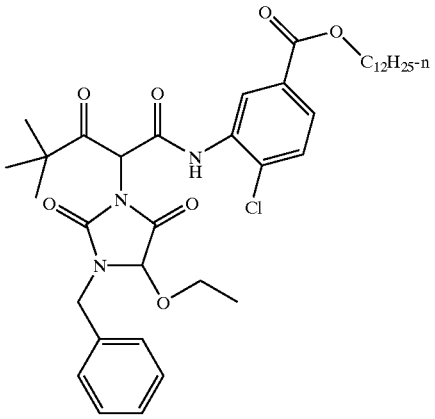
YC17
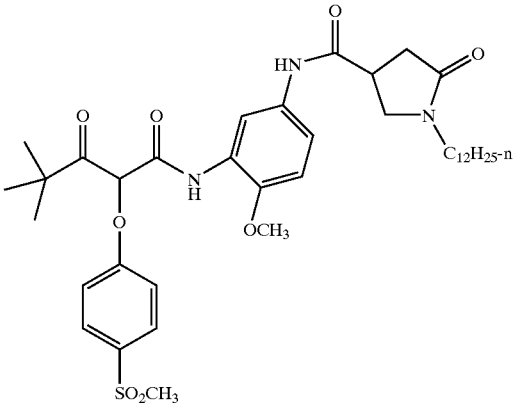
YC18
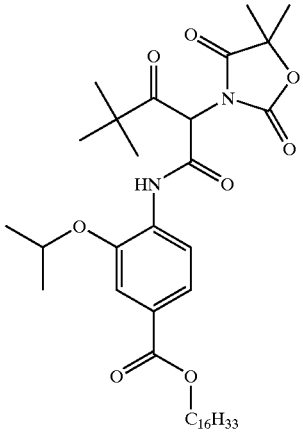
YC19
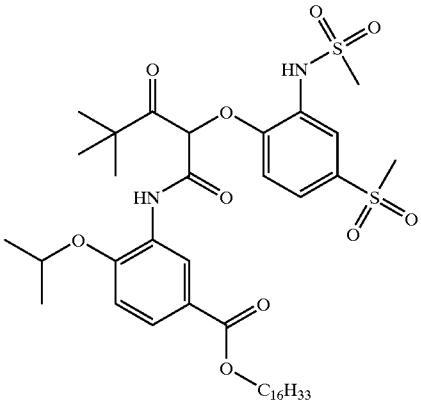
YC20
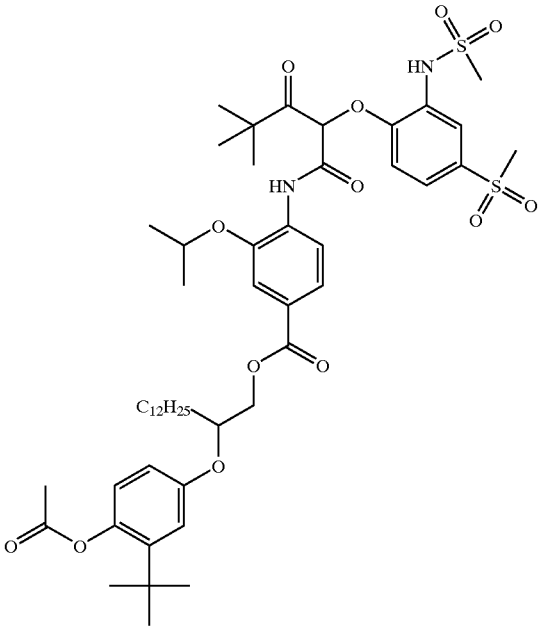

-continued
YC21
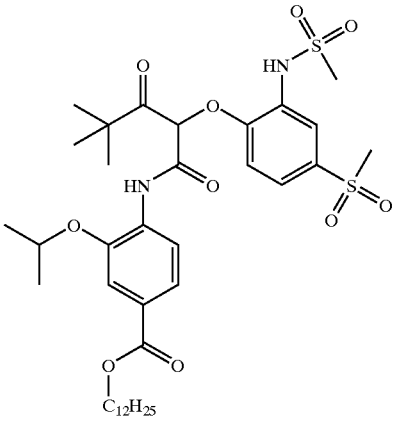
MC1
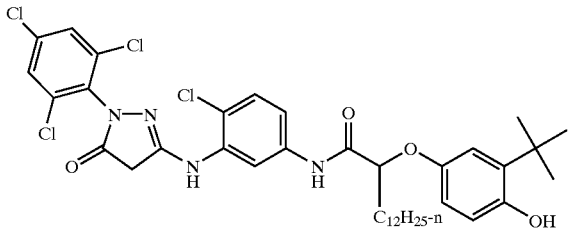
MC2
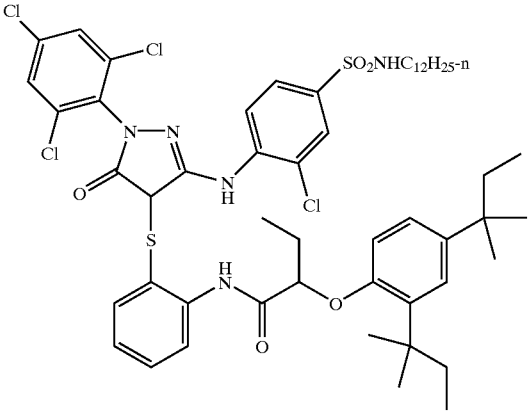
MC3
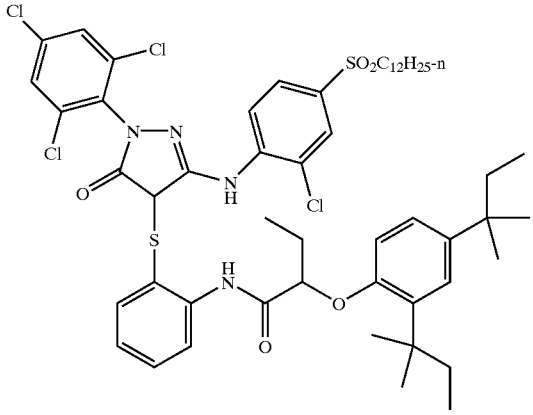
MC4
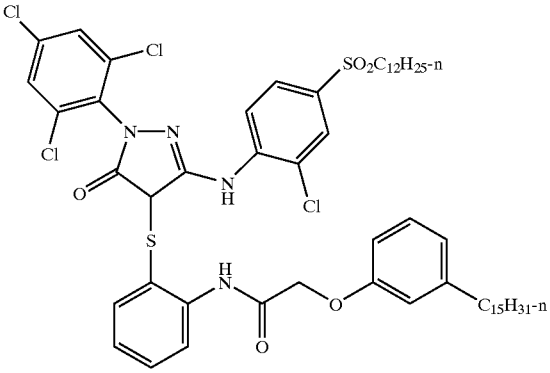
MC5
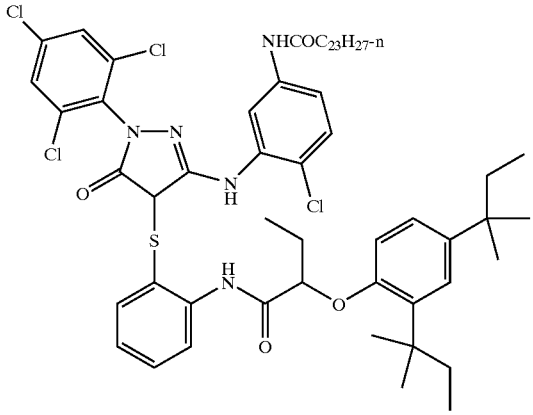
MC6
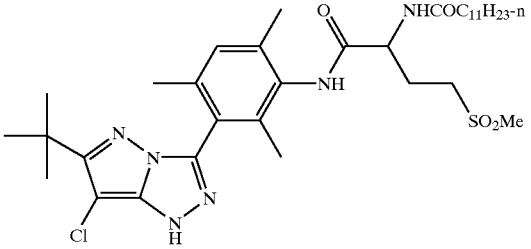
MC7
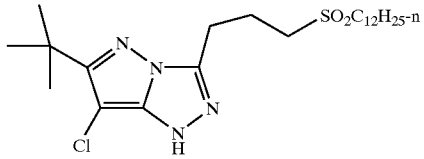

-continued
MC8
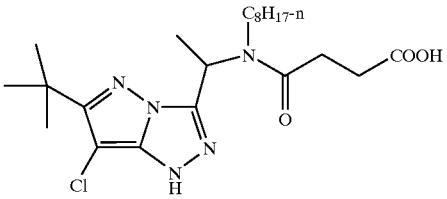
MC9
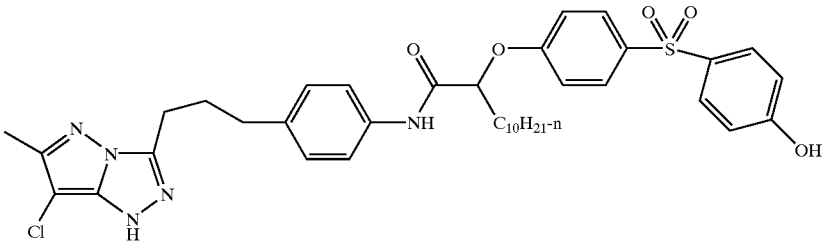
MC10
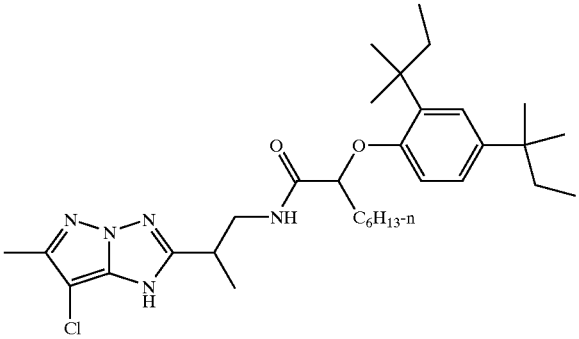
MC11
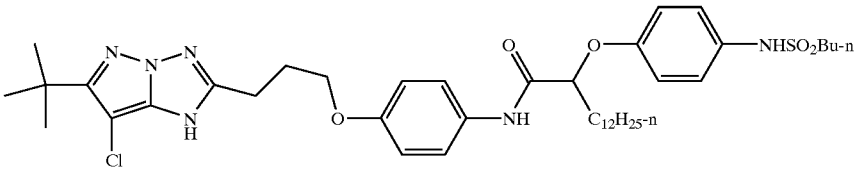
MC12
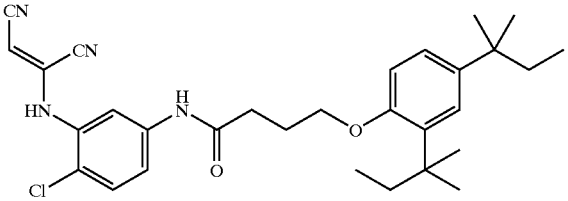
MC13
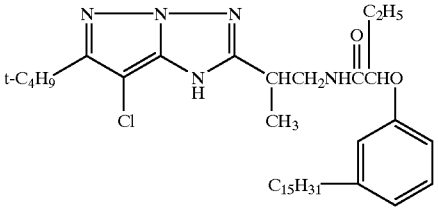
MC14
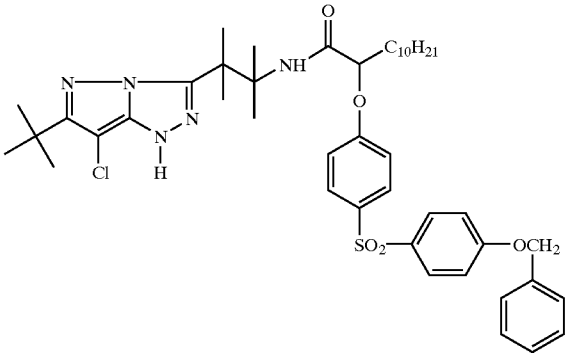
MC15
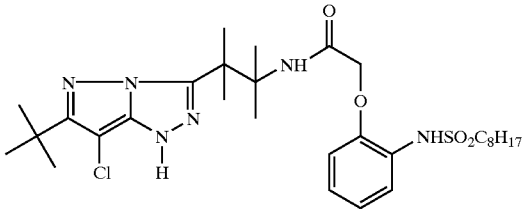

-continued
MC16
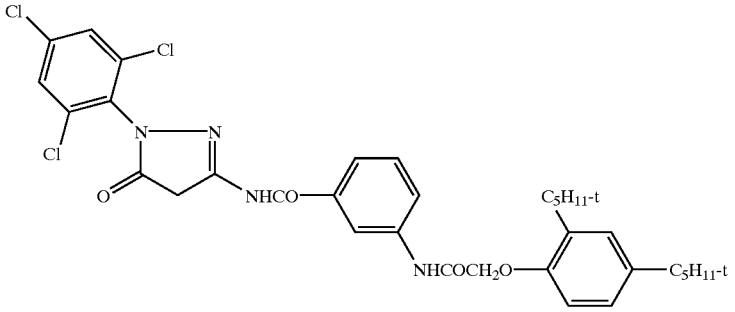
MC17
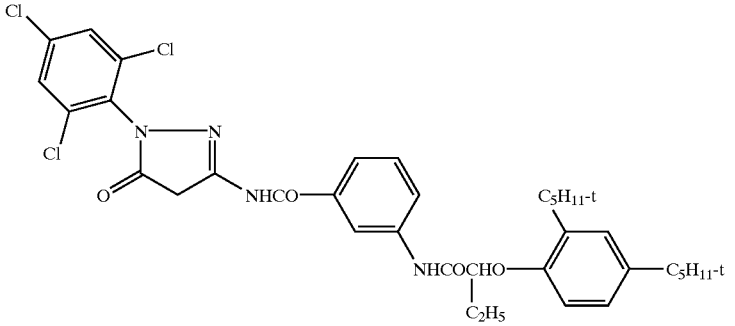
CC1
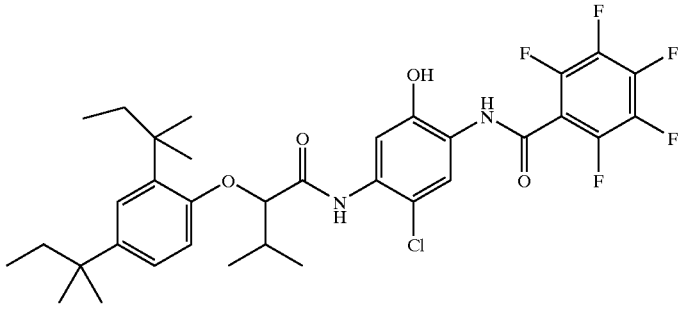
CC2
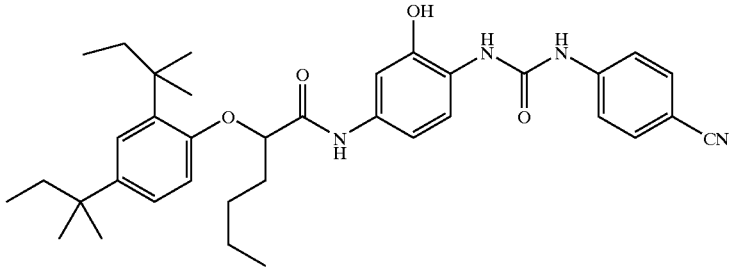
CC3
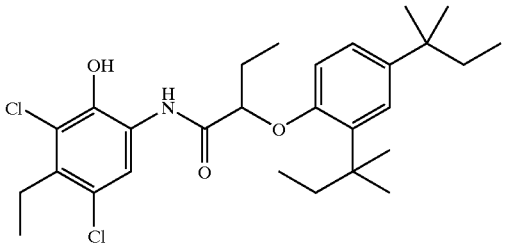
CC4
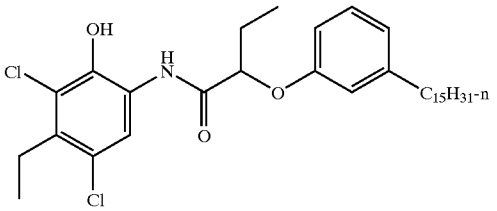

-continued
CC5
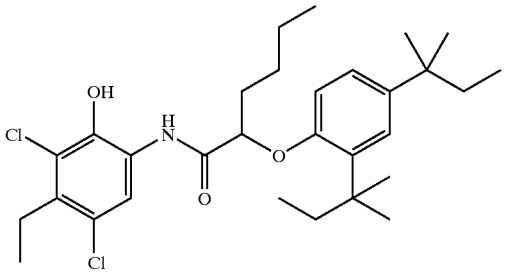
CC6
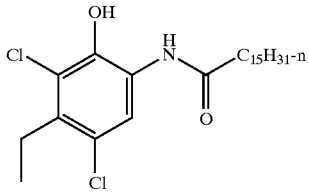
CC7
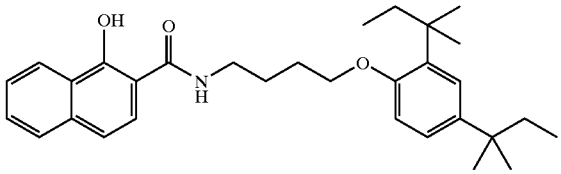
CC8
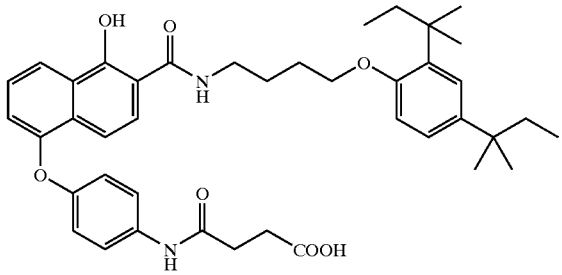
CC9
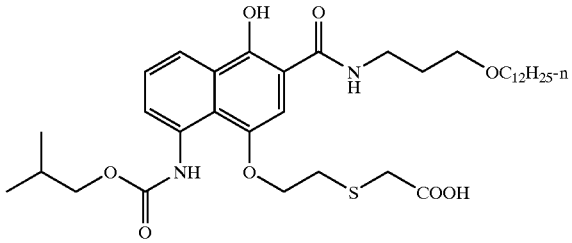
CC10
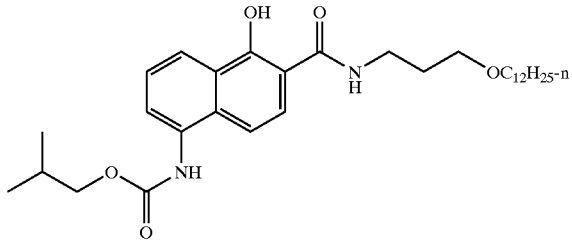
CC11
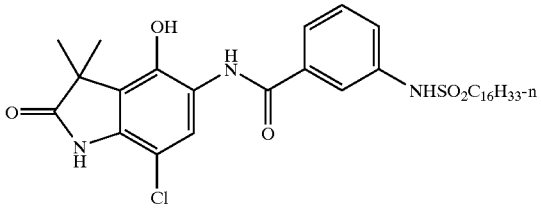
CC12
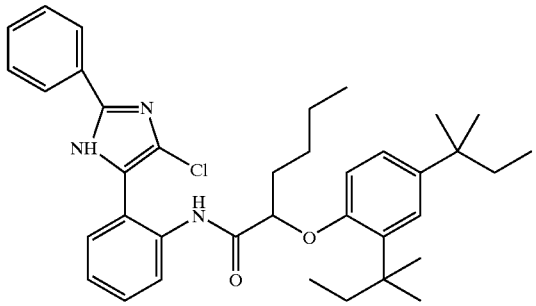
CC13
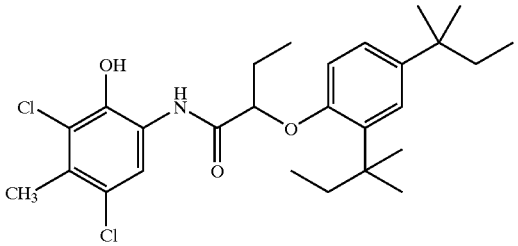
CC14
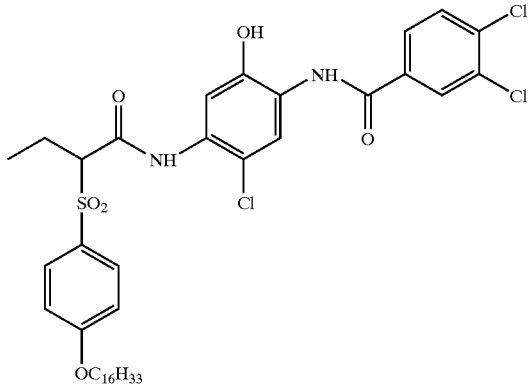

-continued

CC15

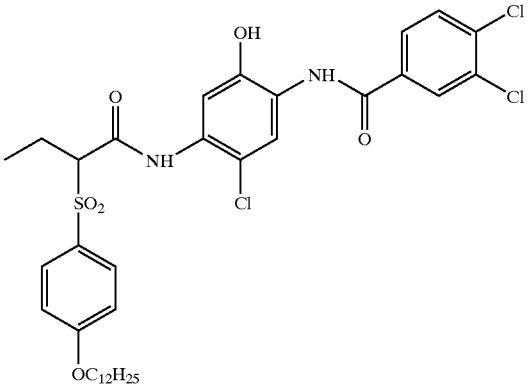

CC16

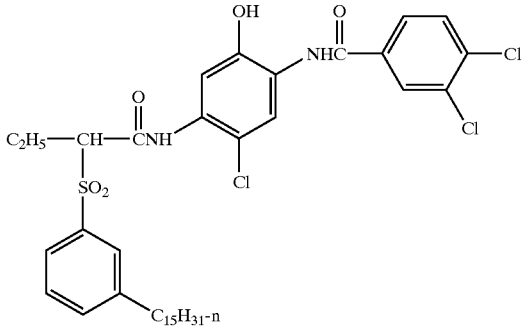

C17

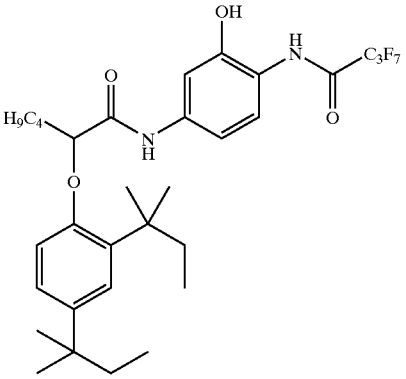

Typically, couplers and any stabilizers with which they are associated are dispersed in the same layer of the photographic element in a permanent high boiling organic compound known in the art as a coupler solvent, either alone or with auxiliary low boiling or water miscible solvents which are removed after dispersion formation. Permanent high boiling solvents have a boiling point sufficiently high, generally above 150° C. at atmospheric pressure, such that they are not evaporated under normal dispersion making and photographic layer coating procedures. Alternatively, the couplers and stabilizers may be dispersed without permanent high boiling solvents using only auxiliary solvent or precipitation techniques as is known in the art. The compounds may be co-dispersed, or may be dispersed separately and then combined. Representative conventional coupler solvents include phthalic acid alkyl esters such as diundecyl phthalate, dibutyl phthalate, bis-2-ethylhexyl phthalate, and dioctyl phthalate, phosphoric acid esters such as tricresyl phosphate, diphenyl phosphate, tris-2-ethylhexyl phosphate, and tris-3,5,5-trimethylhexyl phosphate, citric acid esters such as tributyl acetylcitrate, tributylcitrate and trihexylcitrate, 2-(2-Butoxyethoxy)ethyl acetate, and 1,4-Cyclohexyldimethylene bis(2-ethylhexanoate), benzoic acid esters such as octyl benzoate, aliphatic amides such as N,N-diethyl lauramide, N,N-Diethyldodecanamide, N,N-Dibutyldodecanamide, mono and polyvalent alcohols such as oleyl alcohol and glycerin monooleate, and alkyl phenols such as p-dodecyl phenol and 2,4-di-t-butyl or 2,4-di-t-pentyl phenol. Commonly used coupler solvents are the phthalate esters, which can be used alone or in combination with one another or with other coupler solvents. Selection of the particular coupler solvent has been found to have an influence on the activity of the coupler as well as the hue and stability of the dye formed on coupling. In accordance with certain embodiments, the compounds of Formula I may be advantageously used to partly or totally replace conventional high boiling solvents in dispersing dye-forming couplers in the photographic elements of the invention.

Typically the amount of compound of Formula I used will range from about 0.05 to about 4.0 moles per mole of coupler, preferably from about 0.1 to 2.5 moles per mole of coupler. The coupler is typically coated in the element at a coverage of from 0.25 mmol/$m^2$ to 2.0 mmol/$m^2$, and preferably at a coverage of from 0.40 to 1.2 mmol/$m^2$. When a conventional permanent coupler solvent is also employed, it typically is present in an amount of 0.1 to 5.0 mg/mg coupler, and preferably in an amount of 0.25 to 2.0 mg/mg coupler.

The photographic elements of this invention can be black and white (including chromogenic black and white elements using, for example, yellow, magenta and cyan dye forming couplers), single color elements or multicolor elements. In accordance with preferred embodiments of the invention, the photographic elements comprise at least one yellow dye image forming layer, at least one cyan dye image forming layer and at least one magenta dye image forming layer. More particularly, multicolor photographic elements in accordance with preferred embodiments of the invention preferably comprise a support bearing light sensitive image dye forming layers sensitized to the blue (approx. 380–500 nm), green (approx. 500–600 nm), and red (approx. 600–760 nm) regions of the electromagnetic spectrum. In accordance with a preferred embodiment of the invention, the element comprises cyan, magenta and yellow dye forming silver halide emulsion hydrophilic colloid layer units sensitized to the red, green and blue regions of the spectrum. Each unit can comprise a single emulsion layer or multiple emulsion layers sensitive to a given region of the spectrum. The layers of the element, including the layers of the image forming units, can be arranged in various orders as known in the art. It is within the scope of this invention, however, for the light sensitive material to alternatively or additionally be sensitive to one or more regions of the electromagnetic spectrum outside the visible, such as the infrared region of the spectrum. In most color photographic systems, non-diffusing color-forming couplers are incorporated in the light-sensitive photographic emulsion layers so that during development, they are available in the emulsion layer to react with the color developing agent that is oxidized by silver halide image development. When the dye image formed is to be used in situ, couplers are selected which form non-diffusing dyes. Color photographic systems can also be used to produce black-and-white images from non-diffusing couplers as described, e.g., by Edwards, et al., in International Publication No. WO 93/012465.

Photographic elements of this invention can have the structures and components described in an article titled "Typical and Preferred Color Paper, Color Negative, and Color Reversal Photographic Elements and Processing," published in Research Disclosure, February 1995, Item 37038, pages 79–114. Research Disclosure is published by Kenneth Mason Publications, Ltd., Dudley Annex, 12a North Street, Emsworth, Hampshire P010 7DQ, ENGLAND. Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. Nos. 4,279,945 and 4,302,523. This invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure,* September 1994, Number 365, Item 36544, which will be identified hereafter by the term "Research Disclosure I." The Sections hereafter referred to are Sections of the Research Disclosure I.

The silver halide emulsions employed in the elements of this invention can be either negative-working, such as surface-sensitive emulsions or unfogged internal latent image forming emulsions, or direct positive emulsions of the unfogged, internal latent image forming type which are positive working when development is conducted with uniform light exposure or in the presence of a nucleating agent. Suitable emulsions and their preparation as well as methods of chemical and spectral sensitization are described in Sections I through V. Color materials and development modifiers are described in Sections V through XX. Vehicles which can be used in the elements of the present invention are described in Section II, and various additives such as brighteners, antifoggants, stabilizers, light absorbing and scattering materials, hardeners, coating aids, plasticizers, lubricants and matting agents are described, for example, in Sections VI through X and XI through XIV. Manufacturing methods are described in all of the sections, other layers and supports in Sections XI and XIV, processing methods and agents in Sections XIX and XX, and exposure alternatives in Section XVI.

Supports for photographic elements of the present invention include polymeric films such as cellulose esters (for example, cellulose triacetate and diacetate) and polyesters of dibasic aromatic carboxylic acids with divalent alcohols (for example, poly(ethylene-terephthalate), poly(ethylene-naphthalates)). Such supports are described in further detail in Research Disclosure I, Section XV. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure,* June 1994, Item 36230, such as the Advanced Photo System, particularly the Kodak ADVANTIX films or cameras.

The photographic elements may also contain materials that accelerate or otherwise modify the processing steps of bleaching or fixing to improve the quality of the image. Bleach accelerators described in EP 193 389; EP 301 477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237, EP 096 570; U.S. Pat. Nos. 4,420,556; and 4,543,323.) Also, the couplers may be blocked or coated in protected form as described, for example, in Japanese Application 61/258,249 or U.S. Pat. No. 5,019,492. The photographic elements may further contain other image-modifying compounds such as developer inhibitor releasing compounds (DIR's).

The silver halide emulsion grains to be used in the invention may be prepared according to methods known in the art, such as those described in *Research Disclosure I* and James, *The Theory of the Photographic Process.* These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as illustrated in *Research Disclosure,* June 1975, item 13452 and U.S. Pat. No. 3,772,031.

The silver halide may be sensitized by sensitizing dyes by any method known in the art, such as described in *Research Disclosure I.* The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I,* section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I,* or in T. H. James, editor, *The Theory of the Photographic Process,* 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog unexposed silver halide (usually chemical or light fogging), followed by treatment with a color developer. Preferred color developing agents are p-phenylenediamines. Especially preferred are: 4-amino-N,N-diethylaniline hydrochloride, 4-amino-3-methyl-N,N-diethylaniline hydrochloride, 4-amino-3-methyl-N-ethyl-N-(b-(methanesulfonamido)ethyl aniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III)(e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The photographic elements in accordance with this invention may be processed in amplification processes that use developer/amplifier solutions described in U.S. Pat. No. 5,324,624, for example. When processed in this way, the low volume, thin tank processing system and apparatus described in U.S. Pat. No. 5,436,118 preferably is employed.

In accordance with preferred embodiments, the invention is specifically directed towards color reversal photographic film elements. Silver halide color reversal films are typically associated with an indication for processing by a color reversal process. Reference to a film being associated with an indication for processing by a color reversal process, most typically means the film, its container, or packaging (which includes printed inserts provided with the film), will have an indication on it that the film should be processed by a color reversal process. The indication may, for example, be simply a printed statement stating that the film is a "reversal film" or that it should be processed by a color reversal process, or simply a reference to a known color reversal process such as "Process E-6" or "K-14". A "color reversal" process in this context is one employing a first developer treatment with a non-chromogenic developer (that is, a developer which will not imagewise produce color by reaction with other compounds in the film, sometimes referenced as a "black and white developer"). Black and white developing agents which may be used in the first development include dihydroxybenzenes or derivatives thereof, ascorbic acid or derivatives thereof, aminophenol and 3-pyrazolidone type developing agents. Such black and white developing agents are well known in the art, e.g., U.S. Pat. Nos. 5,187,050, 5,683,859, 5,702,875. Preferred non-chromogenic developers are hydroquinones (such as hydroquinone sulphonate). The non-chromogenic development is followed by fogging unexposed silver halide, usually either chemically or by exposure to light. Then the element is treated with a color developer which will produce color in an imagewise manner upon reaction with other compounds (couplers), which may be incorporated in the film or introduced during processing. A wide variety of different color reversal processes are well known in the art. For example, a single color developing step can be used when the coupling agents are incorporated in the photographic element or three separate color developing steps can be used in which coupling agents are included in the developing solutions.

Dye-forming couplers may be incorporated directly into the emulsion layers of a color reversal element, or may be introduced during processing (e.g., with standard published K-14 Kodachrome processing). A typical coupler-incorporated color reversal photographic element comprises a support bearing a cyan dye image-forming unit comprising at least one red-sensitive silver halide emulsion layer having associated therewith at least one cyan dye-forming coupler;

a magenta image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. Each silver halide emulsion unit can be composed of one or more layers and the various units and layers can be arranged in different locations with respect to one another. The element may contain additional layers, such as filter layers, interlayers, overcoat layers, subbing layers, and the like. In a typical construction, a color reversal film is distinguished from a color negative film in that it does not have any masking couplers. Furthermore, reversal films have a gamma generally between −1.5 and −4.0, which is much higher than the gamma for typical negative materials.

EXAMPLES

In the following examples, photographic elements are prepared employing compounds of Formula I, or the following comparison compounds as coupler solvents:

CS-1

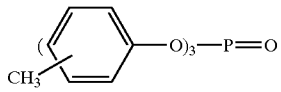

CS-2

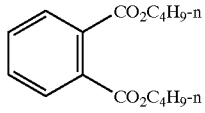

CS-3

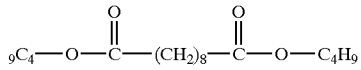

CS-4

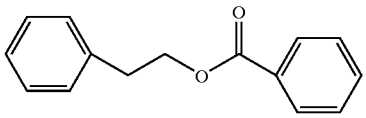

CS-5

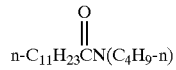

CS-6

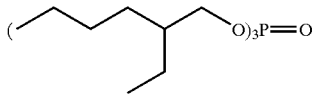

CS-7

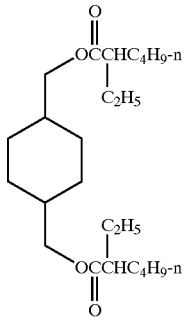

CS-8

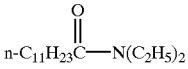

-continued

CS-9

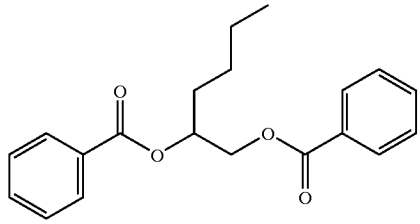

CS-10

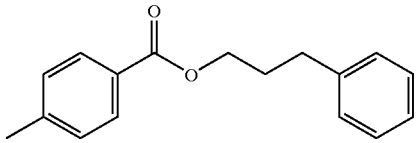

CS-11

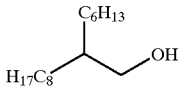

CS-12

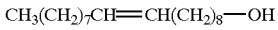

Example 1

Comparison and invention photographic elements employing spectrally sensitized tabular grain emulsions were prepared by coating the following layers on a gel-subbed, acetate support. In the Third Layer, either a compound of Formula I in accordance with the invention or a comparison compound (CS-1, tricresyl phosphate) was used as the coupler solvent, as indicated in Table I below:

First Layer: a photosensitive layer containing (per square meter) 3.23 g gelatin, 1.08 g red-sensitized silver bromo-iodide tabular grain emulsion (3 mol % Iodide based on silver, 1.262 micrometer average ECD by 0.1364 micrometer average thickness, spectrally sensitized with red sensitizing dyes SD-0 and SD-1), a coupler dispersion containing $2.69\times10^{-3}$ mole of cyan coupler CC17, 0.029 g surfactant Olin 10G, and 0.054 g surfactant Triton X-200. The coupler dispersion contained the coupler, coupler solvent di-n-butyl phthalate (coupler:solvent wt ratio 1:0.5), gelatin, and Alkanol XC at a level equal to 10% of the weight of the gelatin in the dispersion.

Second Layer: an interlayer containing (per square meter) 3.23 g gelatin, 0.11 g oxidized-developer scavenger SCV-1, 0.065 g magenta filter dye FD-1, 0.029 g surfactant Olin 10G, and 0.054 g surfactant Triton X-200.

Third Layer: a photosensitive layer containing (per square meter) 4.09 g gelatin, 1.08 g green-sensitized silver bromo-iodide tabular grain emulsion (3 mol % Iodide based on silver, 1.262 micrometer average ECD by 0.1364 micrometer average thickness, spectrally sensitized with green sensitizing dyes SD-4 and SD-5), a coupler dispersion containing $2.69\times10^{-3}$ mole of magenta coupler MC16, 0.029 g surfactant Olin 10G, 0.054 g surfactant Triton X-200. The coupler dispersion contained the coupler, coupler solvent as indicated in Table I (coupler:solvent: 1:0.5), gelatin, and Alkanol XC at a level equal to 10% of the weight of the gelatin in the dispersion.

Fourth Layer: a protective layer containing (per square meter) 3.23 g gelatin, 0.26 g bis(vinylsulfonyl)methane, 0.029 g surfactant Olin 10G, and 0.054 g surfactant Triton X-200.

SD-0:

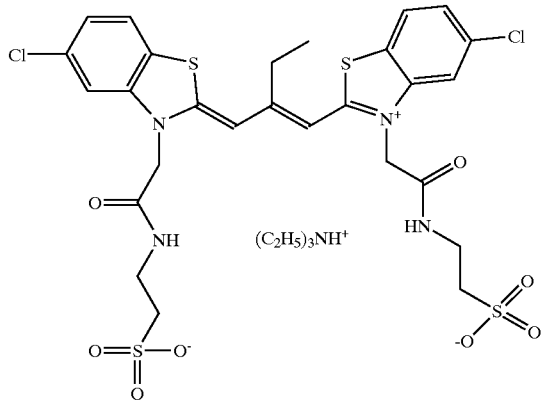

SD-1:

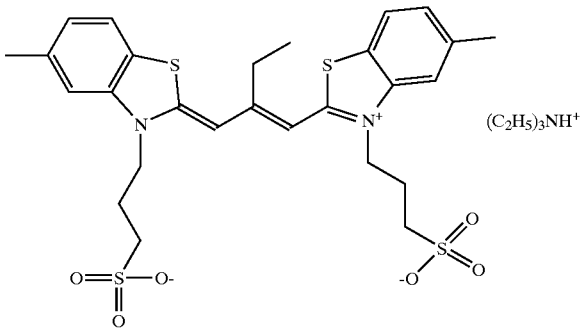

SD-4:

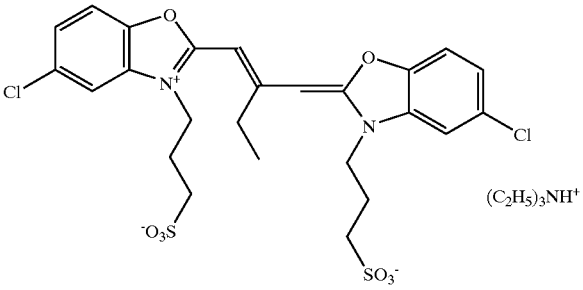

SD-5:

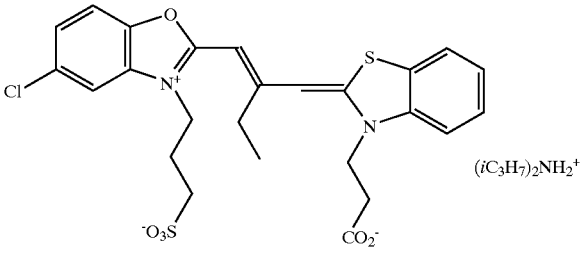

-continued

SCV-1:

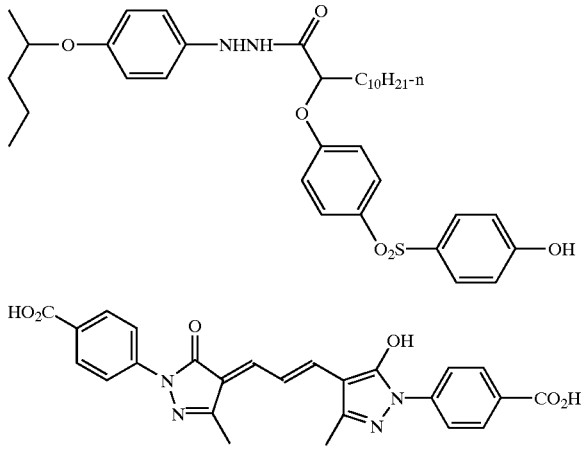

The samples were subjected to a red flash exposure (0.02 seconds, no step wedge, HA-50, WR29 and 0.00 inconel filters) plus a stepwise green exposure (0.02 seconds, 0–3 step wedge, HA-50, WRY99 and 0.60 income filters) on a 1B sensitometer. Samples were then processed using E-6 process solutions and conditions as follows, and were tested to determine whether improvements in photographic performance were observed.

| Process Step | Time (min.) | Temp (° C.) | Agitation |
|---|---|---|---|
| 1st developer | 3.0 | 36.9 | N2 burst (2" on, 8" off) |
| 1st wash | 2.0 | 36.9 | Running tap water |
| Reversal Bath | 2.0 | 36.9 | None |
| Color Developer | 6.0 | 36.9 | N2 burst (2" on, 8" off) |
| Prebleach | 2.0 | 36.9 | None |
| Bleach | 6.0 | 36.9 | Continuous Air |
| Fixer | 4.0 | 36.9 | Air burst (2" on, 8" off) |
| Final Wash | 4.0 | 36.9 | None |

The Status A transmission density of each step of the processed strip to the appropriate color of light was read (green for magenta couplers, blue Dmin for all couplers). From the resulting densities, the Dmax, the highest density measured, was recorded as a % difference from the check.

In addition to the normal E-6 processing, samples were subjected to a special process to better illustrate dye stain effects. This process is related to those that employ short, cool washes in the trade and exacerbate the problem of retained sensitizing dyes.

Dye Stain Evaluation Modified Processes: a normal E-6 process in which the Final Wash and Final Rinse are replaced by a 2-minute wash at 21.2° C. (short, cool wash). A second process uses a 30-minute wash at 36.9° C. (long wash). Coatings for either process are overexposed to produce a Dmin with no image dye according to the following exposure conditions on a 1B sensitometer: 1.0 second, no step wedge, HA-50, DLVa filters (no inconel filter). The long wash is intended to completely wash out any residual sensitizing dye and provides a baseline for coatings processed through the short, cool wash. The short, cool wash is intended to exacerbate the retention of sensitizing dye to allow more accurate measurement of retained dye. Coatings processed through the short, cool wash are analyzed by HPLC for their retained dye. Relative values of retained dye are reported in Table I, with the retained level of each dye for the comparison normalized to 100. Coatings processed through the long wash are used for visual comparison.

TABLE I

| | Sample | Coupler solvent in Third Layer | % Delta Green Dmax | Retained Sensitizing Dye SD-0 | SD-4 |
|---|---|---|---|---|---|
| 1.1 | Comparison | Tricresyl phosphate | check | 100 | 100 |
| 1.2 | Invention | Ia | −9 | 49 | 32 |
| 1.3 | Invention | Ib | +4 | 64 | 53 |
| 1.4 | Invention | Ic | −39 | 64 | 40 |
| 1.5 | Invention | If | −33 | 35 | 19 |
| 1.6 | Invention | Ii | −11 | 47 | 33 |
| 1.7 | Invention | It | −3 | 65 | 46 |
| 1.8 | Invention | Iu | −3 | 86 | 68 |
| 1.9 | Invention | Iv | −4 | 81 | 66 |
| 1.10 | Invention | Ix | −12 | 52 | 38 |
| 1.11 | Invention | Iz | −10 | 57 | 41 |

Samples of the invention demonstrate less retention of sensitizing dyes SD-0 and SD-4, which are examples of dyes known to frequently cause undesirable levels of retained dye stain. Compounds of the invention are in general efficacious in reducing the levels of retained dye stain caused by other sensitizing dyes as well.

Example 2

Photographic elements were prepared with First, Second, and Fourth layers coated as in example 1. The Third layer was coated identically to the Third layer of example 1, except that coupler YC2 was employed in place of MC16, with either a compound of Formula I in accordance with the invention or a comparison compound used as the coupler solvent, as indicated in Table II below.

The samples were exposed, processed and analyzed under the same conditions described in example 1. Data for Dmax and relative dye levels are given below:

TABLE II

| | Sample | Coupler solvent in Third Layer | G Dmax | Retained Sensitizing Dye SD-0 | SD-4 |
|---|---|---|---|---|---|
| 2.1 | Comparison | CS-2 | 2.08 | 202 | 282 |
| 2.2 | Comparison | CS-3 | 2.25 | 175 | 274 |
| 2.3 | Comparison | CS-4 | 2.19 | 212 | 330 |
| 2.4 | Comparison | CS-5 | 2.10 | 152 | 233 |
| 2.5 | Comparison | CS-6 | 2.08 | 162 | 252 |
| 2.6 | Comparison | CS-1 | 2.24 | 179 | 258 |
| 2.7 | Comparison | CS-7 | 2.04 | 200 | 309 |
| 2.8 | Comparison | CS-8 | 2.13 | 115 | 176 |
| 2.9 | Comparison | CS-9 | 2.11 | 206 | 300 |
| 2.10 | Comparison | CS-10 | 1.96 | 228 | 315 |
| 2.11 | Comparison | CS-11 | 1.99 | 138 | 201 |

TABLE II-continued

| | Sample | Coupler solvent in Third Layer | G Dmax | Retained Sensitizing Dye SD-0 | SD-4 |
|---|---|---|---|---|---|
| 2.12 | Comparison | CS-12 | 1.87 | 87 | 166 |
| 2.13 | Invention | Ia | 1.94 | 33 | 42 |

Clearly, compounds of the invention retain far less sensitizing dyes relative to compounds commonly employed in the art.

The invention has been described by reference to preferred embodiments, but it will be understood changes can be made to the embodiments specifically described herein within the spirit and scope of the invention.

What is claimed is:

1. A photographic element comprising a silver halide emulsion layer including a spectrally sensitized tabular grain emulsion and having associated therewith a compound of the following Formula I:

I

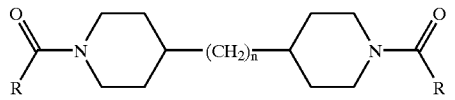

wherein n=0–6 and each R is independently hydrogen, an aromatic, cyclic, linear or branched chain hydrocarbon group, NR'R", or OR'; where R' is an aromatic, cyclic, linear or branched chain hydrocarbon group and R" is hydrogen or an aromatic, cyclic, linear or branched chain hydrocarbon group.

2. An element according to claim 1, wherein each R is independently hydrogen or an aromatic, cyclic, linear or branched chain hydrocarbon group of from 1 to 22 carbon atoms.

3. An element according to claim 1, wherein each R is NR'R", where R' is an aromatic, cyclic, linear or branched chain hydrocarbon group of from 1 to 22 carbon atoms and R" is hydrogen or an aromatic, cyclic, linear or branched chain hydrocarbon group of from 1 to 22 carbon atoms.

4. An element according to claim 1, wherein each R is OR'; where R' is an aromatic, cyclic, linear or branched chain hydrocarbon group of from 1 to 22 carbon atoms.

5. An element according to claim 1, wherein the silver halide emulsion layer has associated therewith a dye forming coupler.

6. An element according to claim 5, wherein each R is independently hydrogen or an aromatic, cyclic, linear or branched chain hydrocarbon group of from 1 to 22 carbon atoms.

7. An element according to claim 5, wherein each R is NR'R", where R' is an aromatic, cyclic, linear or branched chain hydrocarbon group of from 1 to 22 carbon atoms and R" is hydrogen or an aromatic, cyclic, linear or branched chain hydrocarbon group of from 1 to 22 carbon atoms.

8. An element according to claim 5, wherein each R is OR'; where R' is an aromatic, cyclic, linear or branched chain hydrocarbon group of from 1 to 22 carbon atoms.

9. An element according to claim 5, wherein the molar ratio of compound of formula I to dye forming coupler is from 0.05:1 to 4.0:1.

10. An element according to claim 5, wherein the molar ratio of compound of formula I to dye forming coupler is from 0.1:1 to 2.5:1.

11. An element according to claim 5, comprising a color reversal photographic element.

12. A photographic element of claim 11 comprising a support bearing a cyan dye image-forming unit comprising at least one red-sensitive silver halide emulsion layer having associated therewith at least one cyan dye-forming coupler, a magenta image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, wherein the element is substantially free of masking couplers.

13. A photographic element according to claim 12, which exhibits a gamma between −1.5 and −4.0 when processed according to standard E-6 color reversal processing.

14. A photographic element according to claim 13, wherein the spectrally sensitized tabular grain emulsion having the compound of Formula I associated therewith comprises silver iodobromide grains with an iodide content of from 1 to 12 mole %.

15. The photographic element of claim 14 wherein the silver iodobromide grains comprise tabular grains having an average aspect ratio of at least 5:1 which account for greater than 50% of the total grain projected area of the emulsion.

16. The photographic element of claim 14 wherein the silver iodobromide grains comprise tabular grains having an average aspect ratio of at least 7:1 which account for greater than 50% of the total grain projected area of the emulsion.

17. The photographic element of claim 1 wherein the spectrally sensitized tabular grain emulsion comprises tabular grains having an average aspect ratio of at least 5:1 which account for greater than 50% of the total grain projected area of the emulsion.

18. The photographic element of claim 1 wherein the spectrally sensitized tabular grain emulsion comprises tabular grains having an average aspect ratio of at least 7:1 which account for greater than 50% of the total grain projected area of the emulsion.

* * * * *